US007637788B2

(12) United States Patent
Brusoe et al.

(10) Patent No.: US 7,637,788 B2
(45) Date of Patent: Dec. 29, 2009

(54) FUEL FLANGE WITH MOLDED-IN WIRE HARNESS AND DIODE STRUCTURE

(75) Inventors: Michael T. Brusoe, Belleville, MI (US); Matthias Nederegger, Rochester Hills, MI (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 0 days.

(21) Appl. No.: 12/230,215

(22) Filed: Aug. 26, 2008

(65) Prior Publication Data

US 2009/0061692 A1 Mar. 5, 2009

Related U.S. Application Data

(60) Provisional application No. 60/967,114, filed on Aug. 31, 2007.

(51) Int. Cl.
*H01R 9/22* (2006.01)

(52) U.S. Cl. ..... 439/722

(58) Field of Classification Search ..... 439/722, 439/655, 736, 620.21, 620.01; 29/755, 883; 73/756

See application file for complete search history.

(56) References Cited

U.S. PATENT DOCUMENTS

| | | | | |
|---|---|---|---|---|
| 5,598,824 | A * | 2/1997 | Treusch et al. | 123/470 |
| 6,335,548 | B1 * | 1/2002 | Roberts et al. | 257/98 |
| 6,461,017 | B2 * | 10/2002 | Selkee | 362/237 |
| 6,821,146 | B2 * | 11/2004 | Tolmie | 439/577 |
| 6,981,662 | B2 * | 1/2006 | Luedicke | 239/585.1 |
| 7,204,724 | B2 | 4/2007 | Holtz | |
| 7,233,111 | B2 * | 6/2007 | Nagai et al. | 315/77 |
| 7,347,177 | B2 | 3/2008 | Tippy et al. | |

* cited by examiner

*Primary Examiner*—Michael C Zarroli

(57) ABSTRACT

A wire harness assembly and flange combination of a mechanical returnless fuel system includes a wire harness assembly (10) having at least two terminals (14'). Each terminal is joined with at least one wire (12') via an electrical connection (15'). Diode structure (16) is electrically connected between the at least two terminals. A body (18) of plastic material encapsulates at least the electrical connection. A flange (20) is molded from plastic material and defines an inside region (26) and an outside region (22). The terminals are accessible from the outside region of the flange, with ends of the wires being accessible from the inside region of the flange. The plastic material of the flange encapsulates at least a portion of body, the diode structure, and at least a portion of the terminals.

15 Claims, 1 Drawing Sheet

FUEL FLANGE WITH MOLDED-IN WIRE HARNESS AND DIODE STRUCTURE

This application claims the benefit of the earlier filing date of U.S. Provisional Application No. 60/967,114, filed on Aug. 31, 2007, which is incorporated by reference herein in its entirety.

FIELD OF THE INVENTION

The invention relates to mechanical returnless fuel delivery systems for use in a vehicle fuel tank and, more particularly, to a wire harness assembly with a diode structure sealed with respect to a flange of the system.

BACKGROUND OF THE INVENTION

In a mechanical returnless fuel system (MRFS), a fuel pump motor is energized by the maximum vehicle battery voltage for operating the fuel pump motor at a single speed in contrast to an electronic returnless fuel system (ERFS) which typically utilizes a computer or standalone module to electrically control the duty cycle of the fuel pump motor to provide the precise amount of fuel as demanded. All MRFS are relay switched. An advantage of the MRFS is that the MFRS is less costly than the ERFS.

A diode is provided across the power leads for the fuel pump motor at a location remote from the flange that is mounted to a fuel tank. The diode cannot be incorporated into the fuel pump, disposed in the fuel tank, due to exposure of the diode to the conductive and corrosive fuel.

Thus, there is a need to provide an MRFS that has a diode provided on an electrical connector associated with the flange, with the diode being sealed from the corrosive fuel.

SUMMARY OF THE INVENTION

An object of the invention is to fulfill the need referred to above. In accordance with the principles of the present invention, this objective is achieved by providing a wire harness assembly and flange combination of a mechanical returnless fuel system. The system includes a wire harness assembly having at least two terminals. Each terminal is joined with at least one wire via an electrical connection. Diode structure is electrically connected between the at least two terminals. A body of plastic material encapsulates at least the electrical connection. A flange is molded from plastic material and defines an inside region and an outside region. The terminals are accessible from the outside region of the flange, with ends of the wires being accessible from the inside region of the flange. The plastic material of the flange encapsulates at least a portion of body, the diode structure, and at least a portion of the terminals.

In accordance with another aspect of an embodiment, a wire harness assembly and flange combination of a mechanical returnless fuel system includes a wire harness assembly having at least two terminals. Each terminal is joined with at least one wire via an electrical connection. Diode structure is electrically connected between the at least two terminals, and a body of plastic material encapsulates at least the electrical connection. A flange defines an inside region and an outside region. The terminals are accessible from the outside region of the flange, with ends of the wires being accessible from the inside region of the flange. At least a portion of the body and the entire diode structure is in sealed relation with the flange.

In accordance with yet another aspect of an embodiment, a method provides a wire harness assembly and flange combination of a mechanical returnless fuel system. A wire harness assembly includes at least two terminals, with diode structure electrically connected between the at least two terminals. A flange is molded from plastic material to define an inside region and an outside region. The terminals are accessible from the outside region of the flange. The molding step includes molding the plastic material of the flange to encapsulate the diode structure and at least a portion of the terminals.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENTS

Figure 1:
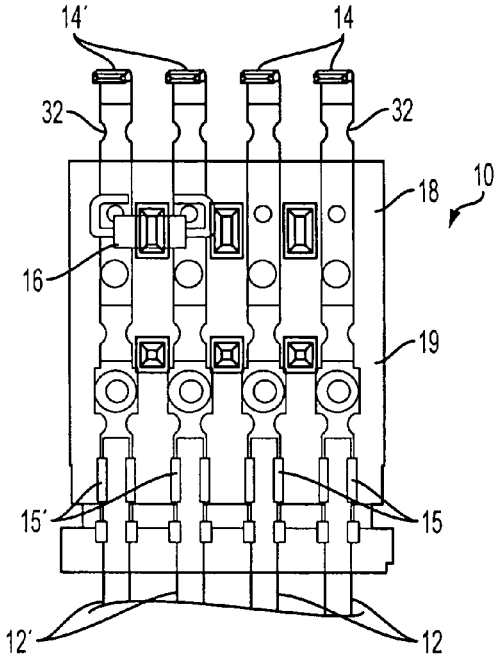
FIG. 1 is a partial front view of an embodiment of a wire harness including an electrical connector and diode.

With reference to FIG. 1, in accordance with an embodiment of the invention, a wire harness is shown, generally indicated at 10, including two wires 12 for powering a level sender and two wires 12' provided for powering a fuel pump (not shown). Ends of the wires 12 are preferably connected by a crimp connection 15 to an associated terminal 14. Also, ends of wires 12' are preferably connected by a crimp connection 15' to terminals 14'. Other means for electrically connecting the ends of the wires 12, 12' to the associated terminals 14, 14' can be used such as soldering, or other mechanical or chemical connections.

Diode structure 16 is provided between at least terminals 14' of the fuel pump motor so that forward current to the pump motor goes to the motor and not through the diode structure 16. In FIG. 1, the diode structure 16 is a single diode electrically connected between the pair of terminals 14'. Electrical noise from the pump motor however, is shorted across the diode 16. Thus, the diode 16 acts as a noise suppression device.

A plastic body 18 is molded over the connection (e.g., crimp connections 15, 15') between the wires 12, 12' and the associated terminals 14, 14' thereby eliminating the need for a sealed connector and thus reducing packaging space. The body 18 thus defines a pre-mold structure. The diode structure 16 is preferably also completely molded over by the plastic material 19 in forming the body 18. The terminals 14, 14' are constructed and arranged to be connected to a control system located outside of a fuel tank (not shown). The control system includes the conventional pump relay (not shown) for operating the fuel pump. The pump relay can be of the type such as disclosed in U.S. Pat. No. 7,347,177, the content of which is hereby incorporated by reference into this specification. Ends of the wires 12 and 12' are available inside of the fuel tank for powering components as noted above. Although four wires and terminal pairs are shown, fewer or more than four pairs can be provided.

Figure 2:
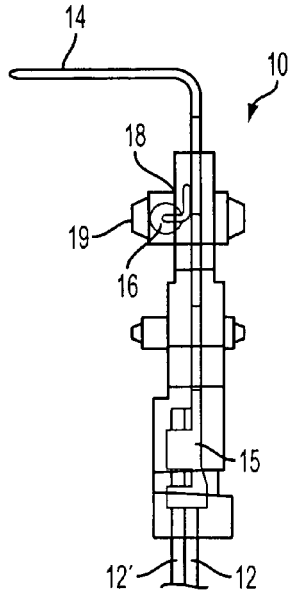
FIG. 2 is a partial side view of the wire harness including an electrical connector and diode of FIG. 1.
Figure 3:
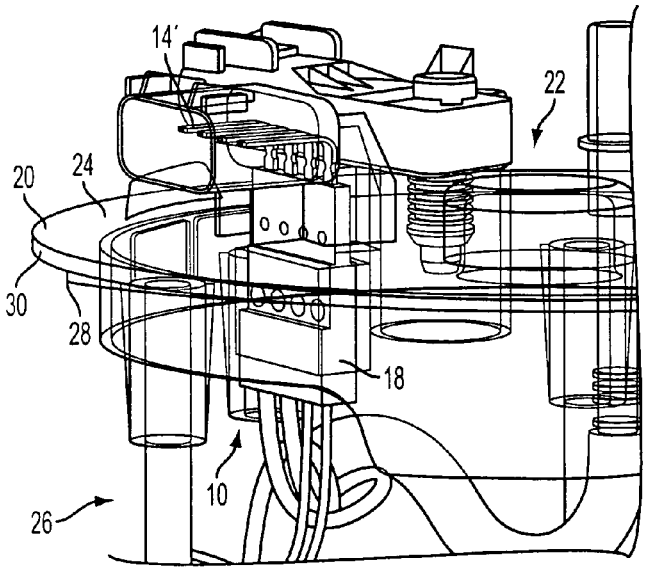
FIG. 3 is a view of a flange of a MRFS incorporating the wire harness of FIG. 1.

With reference to FIG. 2, a plastic flange 20 is constructed and arranged to seal an opening in a fuel tank of a vehicle in the conventional manner. The flange 20 defines an outside region, generally indicated at 22, via outside surface 24, and an inside region, generally indicated at 26, via an inside surface 28.

The pre-mold body 18 is placed in a flange tool and plastic material 30 (such as, for example acetel thermoplastic resin) of the flange 20 is directly over molded onto a portion of the body 18 and diode structure 16, and at least portions of the terminals 14, 14'. This ensures that a barrier or seal to the outside of the fuel tank is created, preventing permeation and liquid leakage. Since the diode structure 16 is completely encapsulated by plastic, the diode structure 16 and the electrical leads thereof are sealed with respect to the flange 20 and are thus protected from corrosive elements of the fuel, or from electrolytic corrosion if the fuel is mildly conductive which is the case for E85 fuel.

As shown in FIG. 2, each terminal 14, 14' includes a surface feature 32 that aids in creating a robust connection of the terminals 14, 14' with the over molded plastic of the flange 20.

Instead of completely over molding the diode structure 16 when forming the body 18, the diode structure can be electrically connected to the pump terminals 14' and then the body 18 and diode structure 16 can be over molded directly with the plastic material 30 of the flange 20 as noted above. Thus, in this process, the diode structure 16 is covered only by the plastic 30 of the flange 20.

Instead of providing a plastic flange 20, the flange can be metal. In this embodiment, the diode structure 16 is over molded completely when forming the body 18 as in FIG. 1. However, the body 18 is not over molded by the flange 20. Instead, the body 18 with diode structure 16 is assembled into a bore in the flange 20 and sealed with respect thereto via a seal, such as an O-ring.

Figure 4:
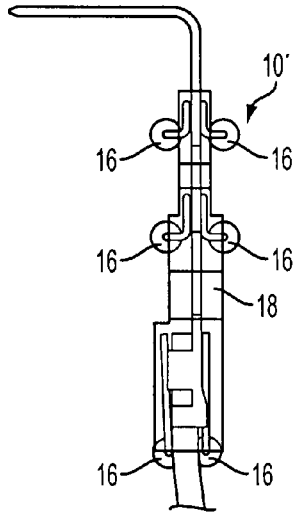
FIG. 4 is a partial view of another embodiment of a wire harness including a pair of diodes provided at both the front and back of an electrical connector.

FIG. 4 is another embodiment of the wring harness 10' showing various locations of the diode structure 16 on either side of the body 18.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the scope of the following claims.

What is claimed is:

1. A wire harness assembly and flange combination of a mechanical returnless fuel system, the combination comprising:

the wire harness assembly including at least two terminals, each terminal being joined with at least one wire via an electrical connection, diode structure electrically connected between the at least two terminals, and a body of plastic material encapsulating at least the electrical connection, and the flange molded from plastic material, the flange defining an inside region and an outside region, the terminals being accessible from the outside region of the flange, with ends of the wires being accessible from the inside region of the flange, wherein the plastic material of the flange encapsulates at least a portion of body, the diode structure, and at least a portion of the terminals.

2. The combination of claim 1, wherein the electrical connection is a crimp connection.

3. The combination of claim 1, wherein the electrical connection is a solder connection.

4. The combination of claim 1, wherein the plastic material of the flange and of the body is acetel resin.

5. The combination of claim 1, wherein four terminals and four associated wires are provided, two of the terminals and associated wires being constructed and arranged to provide power to a fuel pump, the diode structure being a single diode electrically connected between the two terminals that power the fuel pump.

6. The combination of claim 1, wherein the body of plastic material encapsulates at least the electrical connection and the diode structure.

7. A wire harness assembly and flange combination of a mechanical returnless fuel system, the combination comprising:

the wire harness assembly including at least two terminals, each terminal being joined with at least one wire via an electrical connection, diode structure electrically connected between the at least two terminals, and a body of plastic material encapsulating at least the electrical connection, and the flange defining an inside region and an outside region, the terminals being accessible from the outside region of the flange, with ends of the wires being accessible from the inside region of the flange, wherein at least a portion of the body and the entire diode structure is in sealed relation with the flange.

8. The combination of claim 7, wherein the flange is metal and the body of plastic material encapsulates at least the electrical connection and the diode structure, with the body being in sealed relation with the flange.

9. The combination of claim 7, wherein the body of plastic material encapsulates at least the electrical connection and the diode structure and wherein the flange is of plastic material with the plastic material of the flange encapsulating at least a portion of body, the diode structure, and at least a portion of the terminals.

10. The combination of claim 7, wherein the flange is of plastic material with the plastic material of the flange encapsulating at least a portion of body, the diode structure, and at least a portion of the terminals.

11. The combination of claim 7, wherein the electrical connection is a crimp connection.

12. The combination of claim 7, wherein the electrical connection is a solder connection.

13. The combination of claim 9, wherein the plastic material of the flange and of the body is acetel resin.

14. The combination of claim 10, wherein the plastic material of the flange is acetel resin.

15. The combination of claim 7, wherein four terminals and four associated wires are provided, two of the terminals and associated wires being constructed and arranged to provide power to a fuel pump, the diode structure being a single diode electrically connected between the two terminals that power the fuel pump.

* * * * *